United States Patent [19]

Lancet

[11] 4,439,210

[45] Mar. 27, 1984

[54] METHOD OF CATALYTIC GASIFICATION WITH INCREASED ASH FUSION TEMPERATURE

[75] Inventor: Michael S. Lancet, Pittsburgh, Pa.

[73] Assignee: Conoco Inc., Wilmington, Del.

[21] Appl. No.: 311,681

[22] Filed: Oct. 15, 1981

Related U.S. Application Data

[63] Continuation-in-part of Ser. No. 305,654, Sep. 25, 1981.

[51] Int. Cl.[3] ..... C10J 3/14; C10J 3/16

[52] U.S. Cl. ..... 48/202; 48/203; 48/206; 252/373

[58] Field of Search ..... 48/202, 203, 197 R, 48/206, 210; 44/15 R, 10 R, 16 C, 16 E; 252/373

[56] References Cited

U.S. PATENT DOCUMENTS

| | | | |
|---|---|---|---|
| 2,579,397 | 12/1951 | Roetteli | 48/202 |
| 3,920,417 | 11/1975 | Fernandes . | |
| 4,060,478 | 11/1977 | Lang | 48/197 R |
| 4,092,125 | 5/1978 | Stambaugh . | |
| 4,192,652 | 3/1980 | Smith | 44/15 R |
| 4,225,457 | 9/1980 | Schulz | 48/202 |
| 4,230,460 | 10/1980 | Maust | 44/15 R |
| 4,248,605 | 2/1981 | Lancet . | |
| 4,280,817 | 7/1981 | Chauhan et al. . | |

FOREIGN PATENT DOCUMENTS

| | | | |
|---|---|---|---|
| 1435089 | 5/1976 | United Kingdom | 48/202 |
| 715615 | 2/1980 | U.S.S.R. | 48/206 |

OTHER PUBLICATIONS

Lowry, "Chemistry of Coal Utilization," vol. 1, p. 519, 1945; Supplementary Volume, p. 960, 1963.

Elliott, Martin A., Chemistry of Coal Utilization, Second Sup. Volume, pp. 1596–1597 & 1634-14 1639, 1981.

Lowry, The Chemistry of Coal Utilization Supp. Vol. pp. 825–828, 1963.

*Primary Examiner*—Peter F. Kratz

*Attorney, Agent, or Firm*—Dale Lovercheck; William A. Mikesell, Jr.

[57] ABSTRACT

A high ash fusion catalyzed gasification process comprising providing a mixture of 50 to 90 weight percent finely divided carbonaceous material particles of a size smaller than 65 mesh and 10 to 50 weight percent finely divided calcium compound particles of a size smaller than 65 mesh, gasifying the carbonaceous material, the gasifying comprising heating the mixture of finely divided carbonaceous material and finely divided calcium compound to a temperature above the ash fusion temperature of the carbonaceous material and below the ash fusion temperature of the mixture to form a carbonaceous suspension of calcium compound whereby the calcium compound catalyzes the gasification.

9 Claims, No Drawings

METHOD OF CATALYTIC GASIFICATION WITH INCREASED ASH FUSION TEMPERATURE

This is a continuation-in-part of U.S. Ser. No. 305,654 filed Sept. 25, 1981.

BACKGROUND OF THE INVENTION

Stambaugh et al U.S. Pat. No. 4,093,125 discuss prior art methods of impregnating coal with a catalyst by (a) physical admixing of catalyst to coal or (b) soaking the coal in an aqueous solution of catalyst at room temperature and then drying the slurry. Stambaugh et al discloses a method of treating fine particles of solid carbonaceous fuel of a coal or coke type that comprises mixing the fuel particles with a liquid aqueous solution comprising essentially (a) sodium, potassium or lithium hydroxide together with (b) calcium, magnesium or barium hydroxide or carbonate.

Lancet in U.S. Pat. No. 4,248,605 discloses a method of gasifying the bottoms fraction from a coal liquefaction process by mixing the bottoms fraction with at least one finely divided calcium compound selected from the group consisting of calcium oxide, calcium carbonate and calcium hydroxide with the calcium compound being of a size consist no larger than about minus 200 Tyler mesh and present in an amount sufficient to produce agglomerate particles upon mixing with the bottoms fraction and thereafter gasifying the resulting agglomerate particles by reacting the agglomerate particles with steam in a fluidized bed.

SUMMARY OF THE INVENTION

A high ash fusion catalyzed gasification process comprising providing a mixture of 50 to 90 weight percent finely divided solid particles of carbonaceous material of a size smaller than 65 Tyler mesh and 10 to 50 weight percent finely divided particles of a calcium compound, of a size smaller than 65 Tyler Mesh and gasifying the mixture of finely divided solid particles of carbonaceous material and finely divided particles of calcium compound by heating the mixture to an operating temperature above the ash fusion temperature of the carbonaceous material and below the ash fusion temperature of the mixture.

Mixtures of carbonaceous material and calcium compound with 10 percent or more than 10 percent calcium compound are preferred for raising the ash fusion temperature.

Throughout this specification and claims mesh means Tyler mesh.

DETAILED DISCUSSION OF THE INVENTION

In the field of catalytic coal gasification, a problem of continuing concern has been the chemical and physical incorporation of a suitable gasification catalyst in the coal. For example, U.S. Pat. No. 4,092,125 discloses a chemical and physical incorporation of a suitable gasification catalyst in coal by hydrothermally treating the coal. The coal thus treated is a feedstock for a gasification.

The problems of gasifying Eastern U.S. bituminous coals via the dry bottom gasifier are two fold. First is the problem of the low char reactivity which apparently can be raised to a suitable level as discussed above and secondly there is the problem of lower fusion temperatures associated with the ashes of these coals. When the ash fuses in the gasifier operability is substantially, if not completely, impaired by the formation of slag.

To carry out the present invention coal is ground and mixed with ground calcium compound. This mixture of ground coal and ground calcium compound is then gasified. A preferred coal for use in the process of the present invention is bituminous coal from Eastern United States called Eastern Coal.

In a preferred embodiment of the invention, the mixture of ground coal and ground calcium compound are pelletized prior to gasification. For example, the mixture of coal and calcium compound may be briquetted.

In coal gasification by the present invention coal may be contacted with water by the following reaction $$C+H_2O \rightarrow CO+H_2 \quad \text{(I)}$$

Additionally, the CO may react with water as follows $$CO+H_2O \rightarrow CO_2+H_2 \quad \text{(II)}$$

The calcium compound in the ground coal-ground calcium compound mixture may be calcium oxide which when heated in the presence of $CO_2$ such as that formed in reaction II above would react as follows $$CaO+CO_2 \rightarrow CaCO_3 \quad \text{(III)}$$

This reaction of calcium oxide with carbon dioxide is exothermic and produces sufficient heat to maintain the desired reaction temperature in the reactor wherein gasification is occurring for high ratios of Ca to C.

Reactions I, II and III all occur in the reactor which receives the pelletized mixture of finely divided carbonaceous material and finely divided calcium compound.

The present invention relates to a catalyzed gasification process wherein the mixture of finely divided carbonaceous material and finely divided calcium compound particles is gasified after heating the mixture to form a carbonaceous suspension of calcium compound whereby the calcium compound catalyzes the gasification of the carbonaceous material. Because of the intimate contact between the small particles of carbonaceous material and calcium compound in the mixture of solids, when the solids mixture is liquified to form a suspension of calcium compound in carbonaceous material, the distribution of calcium compound in the suspension of carbonaceous material is sufficient for catalysis of the gasification of carbonaceous material during heating.

Preferred calcium compounds for use in the present invention as the finely divided calcium material include lime, calcium carbonate or calcium hydroxide. Preferred carbonaceous material for use as the finely divided carbonaceous material in the present invention include Eastern U.S. bituminous coal, and coal generally. The suspension of catalyzed carbonaceous material formed by the liquifying of a mixture of finely divided carbonaceous material and finely divided calcium compound form a coke product. This coke product may be gasified by any process which will accept coke or char as the feed. For example, a coal-$CaCO_3$ mixture may be briquetted and fed to a fixed bed gasifier such as those described at pages 1634 to 1639 of Elliott, *Chemistry of Coal Utilization*, Second Supplementary Volume, 1981. Alternatively, the mixture may be fed by a screw-type feeding system as the gasifier fuel such screw-type feeder is shown in Fernandes, U.S. Pat. No. 3,920,417.

During gasification the mixture of carbonaceous material and calcium compound may be contacted with molecular oxygen or air or steam or mixtures of the aforesaid air, oxygen and steam.

Within the scope of the invention is a gasification process using a feed material having a carbonaceous suspension of calcium compound made by heating a mixture of finely divided carbonaceous particles of a size smaller than 65 mesh and finely divided calcium compound particles of a size smaller than 65 mesh. The calcium compound is preferably a compound of calcium selected from a group consisting of calcium oxide, calcium carbonate and calcium hydroxide. More preferably the particle size of both the finely divided carbonaceous material and the finely divided calcium compound is smaller than 100 mesh. Most preferably the particle size of the finely divided calcium compound and the finely divided carbonaceous material is less than 200 mesh. Especially preferred is finely divided calcium compound of particle size less than 325 mesh.

Mixtures of −65 mesh about 50% finely divided carbonaceous material and about 50% finely divided calcium compound produce sufficient heat in the top of the gasifier to destroy tars which would leave the gasifier with the product gas and require additional processing to separate them.

Table I gives the chemical composition of the ashes from the residues of the steam-carbon reactivity runs as well as the ash fusion data for these residues. A muffle furnace in air at 1800° F. was used. The data are given for both reducing and and oxidizing atmospheres. The ash fusion temperatures given are: $T_{init}$, the initial deformation temperature; $T_{soft}$, the softening temperature; $T_{hemi}$, the hemispherical temperature and $T_{fluid}$, the fluid temperature. Lowry in Chemistry of coal utilization supplementary Volume 1963 pages 825–828 discusses the ASTM method for measuring these ash-fusing temperatures.

TABLE I

| | Ash Properties of Catalyzed Coal Samples | | | | |
|---|---|---|---|---|---|
| | Uncatalyzed Coal | 90:10 Coal:Chalk | 80:20 Coal:Chalk | 80:20 Coal:Chalk | 70:30 Coal:Chalk |
| Ash Composition (Wt %) | | | | | |
| $K_2O$ | 0.44 | 0.30 | 0.22 | 0.21 | 0.18 |
| $Na_2O$ | 2.18 | 1.24 | 0.81 | 0.73 | 0.61 |
| CaO | 1.58 | 32.89 | 50.02 | 50.23 | 65.05 |
| MgO | 0.72 | 0.60 | 0.60 | 0.60 | 0.62 |
| $Fe_2O_3$ | 14.61 | 8.08 | 6.00 | 5.88 | 4.16 |
| $TiO_2$ | 1.38 | 0.82 | 0.35 | 0.57 | 0.44 |
| $P_2O_5$ | 0.40 | 0.22 | 0.16 | 0.15 | 0.13 |
| $SiO_2$ | 52.14 | 31.73 | 21.18 | 21.03 | 15.39 |
| $Al_2O_3$ | 24.53 | 14.13 | 8.69 | 8.67 | 6.19 |
| $SO_3$ | 0.68 | 8.99 | 10.13 | 10.88 | 4.71 |
| Ash Fusion (°F.) | | | | | |
| Reducing | | | | | |
| $T_{init}$ | 2120 | 2140 | 2460 | 2520 | 2660 |
| $T_{soft}$ | 2320 | 2160 | 2560 | 2600 | 2700 |
| $T_{hemi}$ | 2380 | 2200 | 2620 | 2680 | 2720 |
| $T_{fluid}$ | 2560 | 2240 | 2640 | 2700 | 2740 |
| Oxidizing | | | | | |
| $T_{init}$ | 2360 | 2200 | 2500 | 2540 | 2700 |
| $T_{soft}$ | 2480 | 2220 | 2600 | 2620 | 2720 |
| $T_{hemi}$ | 2540 | 2240 | 2640 | 2690 | 2740 |
| $T_{fluid}$ | 2620 | 2300 | 2660 | 2720 | 2760 |

The most important ash fusion parameter with respect to the usage of a material in a dry bottom gasifier is likely to be the initial deformation temperature since this is the temperature above which the ash will begin to agglomerate. The dry bottom gasifier should be operated so that the temperature at the bottom is very slightly above the initial deformation temperature of the ash. This assures the small degree of ash agglomeration necessary for ash removal but precludes catastrophic slag formation. When the initial deformation temperatures are plotted against the percent $CaCO_3$ in the initial feed, both under reducing conditions and oxidizing conditions, one finds that for addition of $CaCO_3$ in amounts by weight of 10% or greater the $T_{init.}$ is higher than that of the uncatalyzed coal. The ash fusion temperature of Eastern coals can be modified by the addition of $CaCO_3$ in this way so as to improve their performance in the dry bottom gasifier system.

EXAMPLE 1

Seventy pounds of Eastern U.S. coal is ground to −65 Tyler mesh. Thirty pounds of calcium oxide is ground to −200 Tyler mesh. The finely divided Eastern U.S. coal and finely divided calcium oxide are mixed. This mixture is briquetted and fed into the top of a gasifier under reducing conditions and there form an intimate calcium-melted coal suspension which upon coking forms a catalyzed char. This catalyzed char is gasified while moving down the bed. The bed is at a temperature of about 2650° F. which is 530° F. above the intial ash deformation temperature of the coal. This operating temperature of about 2650° F. is about 10° F. below the initial ash deformation temperature of the mixture.

EXAMPLE 2

Seventy pounds of Eastern U.S. coal is ground to −100 Tyler mesh. Thirty pounds of calcium oxide is ground to −200 Tyler mesh. The finely divided Eastern U.S. coal and finely divided calcium oxide are mixed. This mixture is extruded into the top of a gasifier under reducing conditions and there form an intimate calcium-melted coal suspension which upon coking forms a catalyzed char. This catalyzed char is gasified while moving down the bed. The bed is operated at a temperature of about 2650° F. which is about 290° F. above the initial ash deformation temperature of the coal. This operating temperature of about 2650° F. is about 50° F.

below the initial ash deformation temperature of the mixture.

The procedure of the invention shows increases of gasification reaction rates 3 to 6 times those of uncatalyzed pior methods.

Having thus described the present invention by reference to certain of its preferred embodiments, it is respectfully pointed out that the embodiments set forth are illustrative rather than limiting in nature and that many variations and modifications are possible within the scope of the present invention. It is expected that many such variations and modifications will appear obvious and desirable to those skilled in the art based upon a review of the foregoing description of preferred embodiments.

Having thus described the invention, I claim:

1. A process for producing a gaseous product comprising hydrogen and carbon monoxide by high ash fusion temperature catalyzed gasification of bituminous coal at temperatures at least 100° F. above the initial deformation temperature without substantial ash fusion comprising the sequence of steps as follows:

(a) providing a mixture consisting essentially of 50 to 80 weight percent finely divided bituminous coal particles of a size of 65 mesh or smaller than 65 mesh and 20 to 50 weight percent finely divided calcium compound particles of a size smaller than 65 mesh, said calcium compound being selected from the group consisting of calcium oxide, calcium carbonate and calcium hydroxide, said bituminous coal having the property of becoming liquid with sufficient heating, (b) briquetting said mixture to form a briquetted mixture, (c) feeding said briquetted mixture into the top of a fixed bed gasifier, (d) catalytically gasifying said briquetted mixture with steam in said gasifier to form a gaseous product comprising hydrogen and carbon monoxide, said hydrogen and said carbon monoxide each comprising a substantial portion of said gaseous product, said gasifying comprising (i) heating said briquetted mixture of finely divided coal and finely divided calcium compound in said fixed bed gasifier to an operating temperature at least 100° F. above the intial deformation temperature of the ash of said bituminous coal and, said heating forming a catalyzed coke, said catalyzed coke reacting with said added steam to form said gaseous product, (ii) adding steam to said gasifier, said operating temperature being below the initial deformation temperature of the ash of said mixture of said bituminous coal and said calcium compound, whereby said calcium compound catalyzes said gasification, the rate of said catalyzed gasification being substantially increased from the rate of uncatalyzed gasification of said bituminous coal, and said catalyzed gasification being without ash fusion.

2. The process of claim 1 wherein said calcium compound particles have a size smaller than 200 mesh.

3. The process of claim 2 wherein said gasifying further comprises contacting said heated mixture with molecular oxygen.

4. The process of claim 3 wherein said gasifying further comprises contacting said heated mixture with air.

5. The process of claim 1 wherein said coal is Eastern bituminous coal.

6. The process of claim 1 wherein said mixture is from 30 to 50 weight percent finely divided calcium compound and 50 to 70 weight percent finely divided coal.

7. The process of claim 1 wherein said operating temperature is at least 200° F. above the initial deformation temperature of said coal.

8. The process of claim 1 wherein said rate of said catalyzed gasification is three to six times greater than the rate of said uncatalyzed gasification of said bituminous coal.

9. The process of claim 2 wherein said calcium compound particles are of a size smaller than about 325 mesh.

* * * * *